United States Patent [19]

Svensson et al.

[11] Patent Number: 4,940,110

[45] Date of Patent: Jul. 10, 1990

[54] MOBILE WORK UNIT WITH RAISABLE AND LOWERABLE SUPPORT LEGS

[75] Inventors: Ulf Svensson, Badvägen 6 A, Sollentuna, Sweden, S-191 43; Bo Dahlgren, Sollentuna, Sweden

[73] Assignee: Ulf Svensson, Sollentuna, Sweden

[21] Appl. No.: 294,065

[22] PCT Filed: Jun. 24, 1987

[86] PCT No.: PCT/SE87/00295

§ 371 Date: Dec. 27, 1988

§ 102(e) Date: Dec. 27, 1988

[87] PCT Pub. No.: WO88/00262

PCT Pub. Date: Jan. 14, 1988

[30] Foreign Application Priority Data

Jun. 24, 1986 [SE] Sweden ..... 8602803

[51] Int. Cl.[5] ..... B62D 61/12

[52] U.S. Cl. ..... 180/209; 180/308; 280/43.14; 280/43.23; 280/43.24; 280/764.1

[58] Field of Search ..... 180/209, 308; 280/763.1, 764.1, 43.14, 43.17, 43.23, 43.24; 212/189

[56] References Cited

U.S. PATENT DOCUMENTS

| | | | |
|---|---|---|---|
| 3,685,853 | 8/1972 | Goldsmith | 280/764.1 X |
| 4,008,902 | 2/1977 | Dill | 280/43.24 X |
| 4,569,422 | 2/1986 | Hoffman | 280/764.1 X |
| 4,655,269 | 4/1987 | Hanser et al. | 280/764.1 X |

FOREIGN PATENT DOCUMENTS

| | | | |
|---|---|---|---|
| 697009 | 1/1931 | France | 280/43.14 |
| 2044694 | 10/1980 | United Kingdom | 280/43.23 |

*Primary Examiner*—Charles A. Marmor
*Assistant Examiner*—Brian Johnson
*Attorney, Agent, or Firm*—Fleit, Jacobson, Cohn, Price, Holman & Stern

[57] ABSTRACT

A mobile work unit (1) having raisable and lowerable support legs (4, 4'), which adjacent to one end portion are arranged pivotally attached to the work unit (1), and which during a pivoting movement can take up contact with a below located ground plane (6) under influence from an associated piston cylinder (5, 5'). According to the invention, at least one support leg (4, 4') is arranged supporting a linkshaped member (8), pivotally attached to the support leg (4, 4') and extending in a transverse direction extending relationship to the length direction of extension for the support leg (4, 4'). Associated piston cylinder (5, 5') for the operation of the support leg (4, 4') is arranged pivotally attached with a first end portion at the work unit (1), and with the second end portion pivotally attached adjacent to a first end portion of the linkshaped member (8). Opposed end portion of the linkshaped member (8) is attached longitudinally extending member (9), during the pivoting movement of the linkshaped member (8) between two alternative restricting positions being arranged to cause a movement for a vehicle wheel (2, 2', 3, 3') located adjacent to the support leg (4, 4') in substantially the opposed direction in relation to the direction of travel for the support leg (4, 4'). The wheel is preferably located with the wheel center in front of the front portion of the work unit (1) or behind its rear portion. Longitudinal extending member (9) is advantageously rigidly connected to the linkshaped member (8), arranged supporting a drive motor (7) and/or a vehicle wheel (2, 2', 3, 3') adjacent to the opposed end portion.

11 Claims, 4 Drawing Sheets

TO HYDRAULIC
PUMP UNIT

MOBILE WORK UNIT WITH RAISABLE AND LOWERABLE SUPPORT LEGS

CROSS REFERENCE TO RELATED APPLICATION(S)

This U.S. application stems from PCT International application No. PCT/SE87/00295 filed June 24, 1987.

BACKGROUND OF THE INVENTION

The present invention relates to a mobile work unit with raisable and lowerable support legs, for example wheel supported mobile excavators, which, when working, are arranged with lower support legs.

It is desirable to locate the wheel axles of the work unit in such positions in relation to the vehicle body that maximum stability is achieved during transport movement, and with regard to the portion where a movable work device is attached, e.g. an excavator jib with associated bucket, it is of particular importance that an adjacently located pair of wheels are arranged in such a position that the risk for a forward tilting movement is eliminated. However, for such units, having pivotally attached support legs, which by means of a pivoting movement can be moved into a supporting contact position against a ground plane, it has previously not been considered possible to locate the wheel in a forward position in relation to the points of attachment for the support legs against the unit. Such a location is obviously most desirable, since the stability of the work unit thereby can be considerably improved. However, this requires that the vertical position of the wheels can be changed when the support legs are raised/lowered.

SUMMARY OF THE INVENTION

The object of the present invention is to disclose a work unit having the wheels located in a forward and/or rear position in relation to the vehicle body, and also how the support legs can be raised/lowered in relation to the ground plane with a simultaneous movement of adjacent wheels in the opposed direction, said operation being performed as an automatic operation when the support legs are raised/lowered. The present invention also facilitates a simple driving and steering arrangement for the work unit for travel between different work locations, as well as other advantages, which are disclosed in the following descriptive part of the specification.

The mobile work unit according to the present invention is arranged with raisable and lowerable support legs, which adjacent to one end portion are arranged pivotally attached to the work unit, and which during a pivoting movement take up contact with the opposed end portion against a below located ground plane under influence from an associated piston cylinder, and it is mainly characterised in that at least one support leg is arranged supporting a link-shaped member, pivotally attached to the support leg and extending in a transverse direction extending relation to the longitudinal direction of the support leg, and that associated piston cylinder for operating the support leg is pivotally attached with a first end portion against the work unit, the other end portion being pivotally attached adjacent to a first end portion of the link-shaped member, the opposed end portion of said link-shaped member being attached to a movement transferring means, which when the link-shaped member is pivoted between first and second alternative restricting positions causes a movement in substantially opposed direction in relation to the support leg for a vehicle wheel located adjacent to the support leg, the wheel center preferably being located in front of the forward portion or behind the rear portion of the work unit. As a further characteristic feature can be stated, that the movement transferring means comprises of a longitudinally extending member, rigidly connected to the link-shaped member, at the opposed end portion arranged to support a drive motor and/or a vehicle wheel.

BRIEF DESCRIPTION OF THE DRAWINGS

A number of embodiments of a work unit according to the present invention are more fully described below with reference to the example of an embodiment of a work unit shown in the enclosed drawings, in which.

DETAILED DESCRIPTION OF INVENTION

Figure 1:
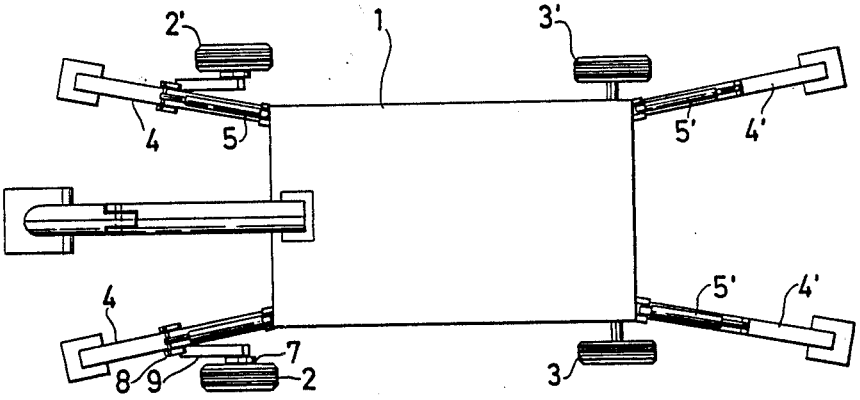
FIG. 1 is a schematical plan view of an excavator having four wheels viewed from above, and with the wheel pair arranged by the support legs located adjacent to the excavator jib in a forward position in relation to the excavator body.

With reference to FIG. 1, a work unit is schematically indicated as an excavator, denominated as a complete unit as 1, having two front wheels, 2 and 2' respectively, and two rear wheels, 3 and 3' respectively. Two groups of pairs of support legs 4, 4' are also shown, pivotally attached adjacent to the corner portions of the excavator 1, arranged to performing a pivoting movement in the vertical plane towards/away from a ground plane 6 when associated hydraulically operated piston cylinders 5, 5' are operated. Such a work unit is of a previously known type, but according to the present invention, the front wheel pair 2, 2' is located in front of the excavator 1, and the piston cylinders 5, 5' are utilized for a further purpose, namely to raise/lower the wheels 2, 2' in relation to adjacently located support legs 4 when same are moved towards/away from the ground plane 6. In this embodiment, the front wheels 2, 2' may also advantageously be arranged connected to an individual hydraulic motor 7 for each wheel 2, 2', which independently of each other can be driven in alternative rotary directions when associated valve means are influenced.

Figure 2:
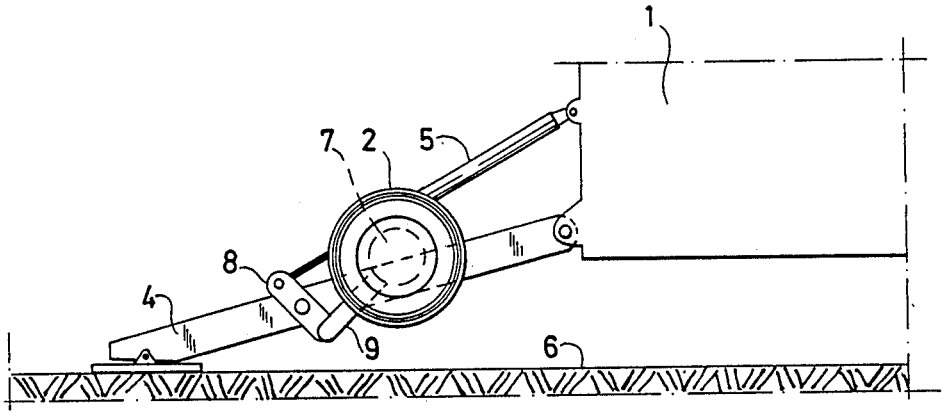
FIG. 2 is a side view of a corner portion of the excavator and a front wheel, with the support leg in a lowered position.
Figure 3:
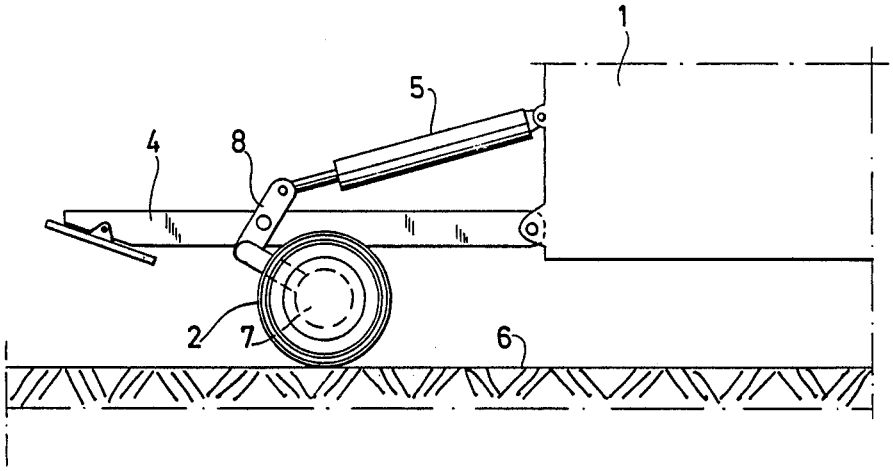
FIG. 3 is a side view corresponding to FIG. 2, but with the wheel lowered into a contact position against the ground plane, the support leg being located in a raised position.
Figure 4:
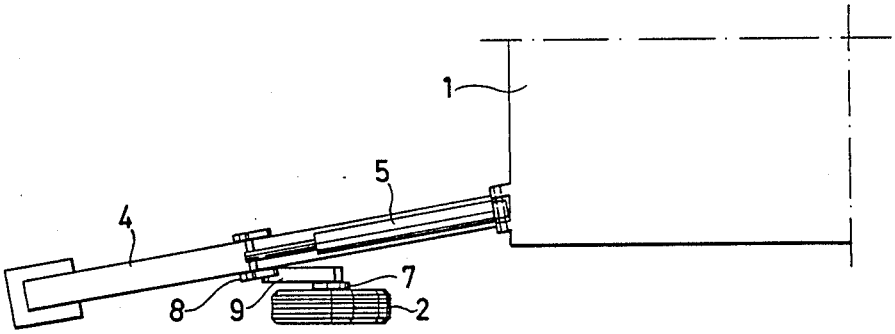
FIG. 4 is a view from above the corner portion shown in FIGS. 2 and 3.

An example of an embodiment, intended to disclose how the piston cylinders 5 moving the forward support legs 4 also can be used to raise/lower the front wheels 2, 2' in relation to the ground plane 6, is shown more in detail in FIGS. 2–4. FIG. 2 shows a support leg 4 in a lowered position, and adjacently located wheel 2 in a lifted position in relation to the ground plane 6. Said figure shows, that the piston cylinder 5 is pivotally attached adjacent to one end portion against the work unit 1, and that the opposed end portion (the piston rod) is pivotally attached against the outer portion of a link-shaped member 8, which is pivotally attached at its central portion against the support leg 4. A longitudinally extending member 9 extends from the opposed end portion of the link-shaped 8, supporting a hydraulic motor 7 at the free end portion, which is attached to the wheel 2. In this shown embodiment, the link-shaped 8 and the longitudinally extending member 9 are internally rigidly joined together, whereby a predetermined angular relationship therebetween is maintained.

By influencing a valve means associated with the piston cylinder 5, the piston rod of the piston cylinder 5 can be moved in direction towards the work unit 1. During a first movement, the link-shaped member 8 is pivoted in direction towards the position shown in FIG. 3, while the longitudinally extending member 9 performs a corresponding pivoting movement in direction towards the ground plane 6, whereby the wheel 2 takes up contact with the ground plane 6. During the continued movement of the piston rod, the support leg 4 is pivoted/lifted in direction away from the ground plane, and if the link-shaped member 8 has not initially been pivoted to the position shown in FIG. 3, this is performed as a final movement.

The work unit can now be moved to a suitable point of location for continued work, and this is advantageously performed by influencing a 2-way valve 10, which interrupts the oil supply to the piston cylinders 5, 5', and transfers the supply of oil under pressure to the drive motors 7 of the front wheels 2, 2'. Hereby, the same operating device/valve utilized for raising/lowering the forward and the rear support legs 4, 4' respectively, can also be used for steering the left and right hydraulic motor 7 respectively.

When the work unit 1 has been moved to desired location, the piston cylinders 5, 5' are again influenced in order to lower the support legs 4, 4'. During a preliminary stage of this movement, the link-shaped member 8 at each support leg 4 maintains a substantially unchanged position, but when the outer end portions of the support legs 4 take up contact with the ground plane 6, less force will be required to lift adjacently located wheels 2, 2' than required to lift the entire work unit 1 by means of the support legs 4, whereby the linkshaped member 8 performs a pivoting movement, which due to a corresponding movement of the associated longitudinally extending member 9 causes associated wheels 2, 2' to be lifted in direction away from the ground plane 6. The resulting position taken up is shown in FIG. 3.

In the above described embodiment, the four wheels 2, 2', 3, 3' are arranged in a fixed and non-steerable position in relation to the work unit. As a result, a turning operation performed during movement results in a "skidding movement" of the rear and not driven wheels 3, 3'. For certain types of units, locating the working device in a suitable position makes it possible to move the center of gravity in such a way that the rear wheel 3, 3' do not carry an unnecessarily high load, but this obviously results in reduced stability.

Figure 6:
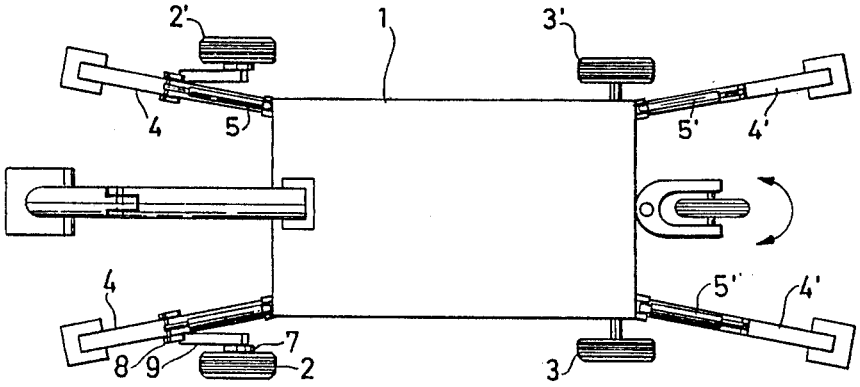
FIG. 6 is a schematical plan view corresponding to FIG. 1, but with the excavator having only one rear wheel which is freely pivotable about a vertical axis.
Figure 7:
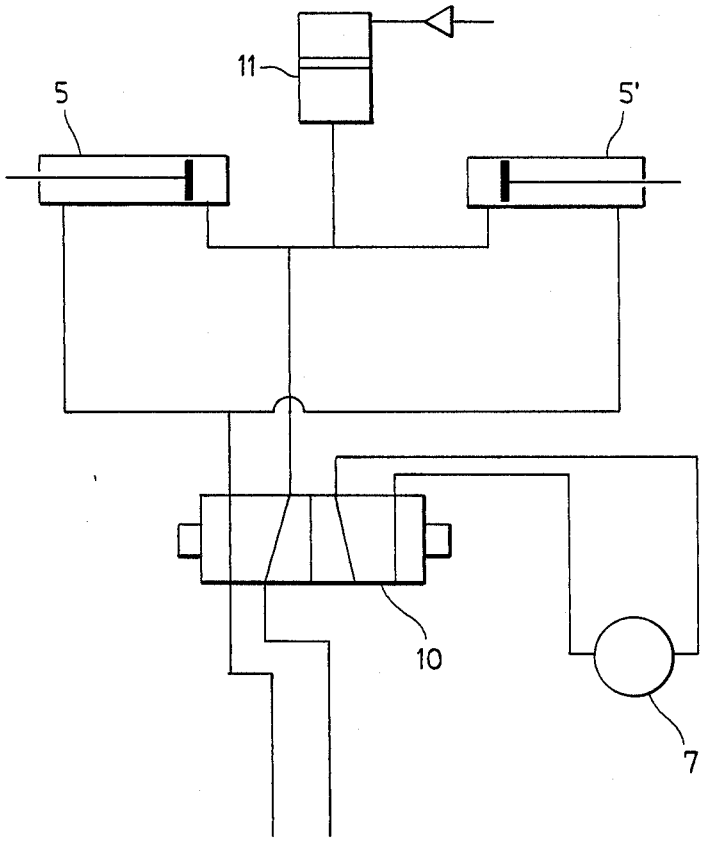
FIG. 7 is an hydraulic circuit diagram.

In order to reduce or eliminate the disadvantages caused when the work unit 1 is turned, the rear wheel pair 3, 3' of the above described embodiment may be replaced by one wheel only (FIG. 6), located adjacent to the length axis of the work unit 1, freely pivotable in the horizontal plane. Such a wheel may advantageously be located in a position behind the work unit, joined with at least one of the rear support legs 4' in a fashion comparable to the front wheel pair 2, 2', whereby the wheel will be raised/lowered in an opposed relationship to the direction of movement for the rear support legs 4'. Such a wheel is further advantageously arranged freely rotatable in the horizontal plane, and when the driven wheels 2, 2' are driven with a different rotary speed in relation to each other, or different rotary directions, the freely rotatable wheel in the horizontal plane will thus take up a position of location adapted to the present turning movement. Hereby is the "skidding movement" avoided as previously discussed with reference to the embodiment including a pair of non-steerable rear wheels 3, 3'.

It is also possible to accomplish a suspension system for the wheels which as previously described are arranged movable in relation to adjacent support legs 4, 4'. When the support legs 4, 4' are located in a raised position, the piston cylinders 5, 5' act as movement absorbing suspension means, but since the piston cylinders 5, 5' are operated by means of a hydraulic medium, the degree of compression possible for such a medium is obviously restricted. The piston cylinders 5, 5' may therefore advantageously be connected to at least one hydraulic accumulator 11 when the support legs 4, 4' have taken up a position moved away from the ground plane 6. The hydraulic accumulator 11 can be of a previously known type, e.g. a container in which the oil under pressure is separated from nitrogen or other gas by means of a diaphragm.

For larger and heavier work units 1, the rigid connection to the link-shaped member 8, formed by means of a fixed longitudinally extending member 9 directed away from the link-shaped member 8, may for example be replaced by a force transferring link, pivotally attached against the link-shaped member 8. The movement of such a force transferring link can be transferred to a crank pin, an excentrically mounted member or similar, arranged rotatably supported by a support leg 4, 4', and carrying associated wheel 2, 2', 3, 3'. As a result, the rather long lever in the shown and described embodiment is avoided, which causes a relatively large application of force at the point of attachment between the link-shaped member 8 and the longitudinally extending member 9.

In the described embodiment, only one wheel pair 2, 2' is arranged to be influenced during the movement of associated support legs 4, but it is obviously also possible to arrange both wheel pairs 2, 2', 3, 3' in a corresponding fashion. Furthermore, there are obviously a number of technical solutions for transferring the movement of each link-shaped member 8 to associated wheel 2, 2', 3, 3', and apart from rigid joints such as links, it is thus also possible to transfer the movement by means of chains, wires or similar, and also such modifications fall within the scope of the invention. It is further also obviously possible to arrange a wheel pair, or a single wheel supporting one end portion, manually turnable in the horizontal plane, in order to facilitate a steering operation for the work unit during a transfer movement.

Figure 5:
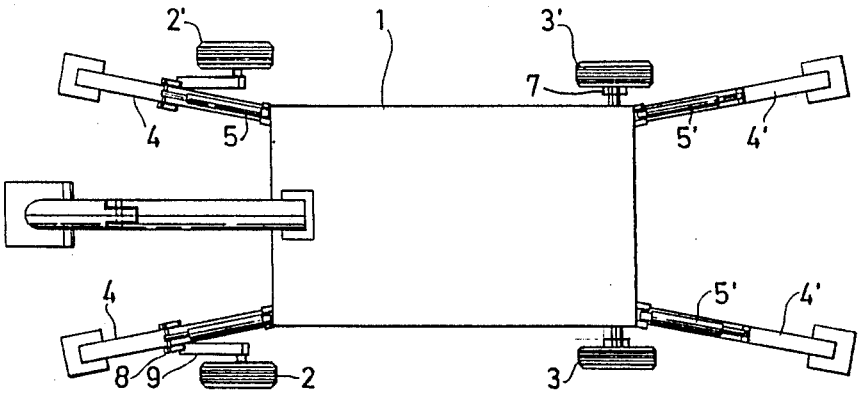
FIG. 5 is a schematical plan view corresponding to FIG. 1, but with drive means located on the rear wheels.

The hydraulic motors 7 may be located on the rear wheels 3,3', instead of the front wheels 2,2', as shown in FIG. 5.

The present invention is thus in no way restricted to the example of an embodiment shown and described, but can be further modified within the scope of the inventive thought and the following claims.

We claim:

1. A mobile work unit comprising:

a body member;

a wheel through which the body member can be supported on a support surface;

a support leg having a support surface engaging end and another end which is pivotally connected to the body member;

a piston-and-cylinder assembly operative between the support leg and the body member for raising the support leg from the support surface and lowering the support leg with its support surface engaging end in contact with the support surface;

a link-shaped member having a pair of opposed ends and pivotally connected, intermediate its opposite ends, to the support leg and extending in a transverse direction relative to the support leg;

the piston-and-cylinder assembly being pivotally connected at its one end to the body member and pivotally connected at its other end to one end of the link-shaped member;

interconnection means for transferring movement between the other end of the link-shaped member and the wheel; and the link-shaped member being pivotable between a first restricting position in which the wheel is in load-bearing contact with the support surface and a second restricting position in which the wheel is out of load-bearing contact with the support surface.

2. The mobile work unit according to claim 1, wherein the rotation axis of the wheel is located between the support surface engaging end of the support leg and the other end of the support leg which is pivotally connected to the body member.

3. The mobile work unit according to claim 1, wherein said movement transferring means comprises a longitudinally extending member, the one end of which is rigidly connected to said other end of the link-shaped member and the wheel being rotatably connected to the other end of the longitudinally extending member.

4. The mobile work unit according to claim 3, including a drive motor at the wheel supporting end of the longitudinally extending member for driving the wheel.

5. The mobile work unit according to claim 1, including an accumulator which is connected to the piston-and-cylinder assembly when the wheel is in load-bearing contact with the support surface.

6. The mobile work unit according to claim 1, wherein the body member has a front end and a rear end and including a further wheel by which the body member is supported on a support surface and which further wheel is mounted for free pivotal movement about a vertical axis and located centrally of the rear end of the body member.

7. The mobile work unit according to claim 1, wherein the rotation axis of the wheel is located at an angle to the longitudinal axis of the support leg.

8. A mobile work unit comprising:

a body member having a front end and a rear end;

a pair of support legs at each of the front and rear ends of the body member, each support leg having a support surface engaging end and another end which is pivotally connected to the body member;

a hydraulic piston-and-cylinder assembly associated with each support leg and operative between the support leg and the body member for raising the support leg from the support surface and lowering the support leg with its support surface engaging end in contact with the support surface;

a link-shaped member having a pair of opposed ends and pivotally connected, intermediate its opposite ends, to each one of the pair of support legs at one end of the body member and extending in a transverse direction relative to the support leg;

the associated piston-and-cylinder assembly being pivotally connected at its one end to the body member and pivotally connected at its other end to one end of the link-shaped member;

a load bearing wheel provided on each of the support legs to which a link-shaped member is connected;

interconnection means for transferring movement between the other end of the link-shaped member and the load bearing wheel on the support leg; and the link-shaped member being pivotable between a first restricting position in which the wheel on the support leg is in load-bearing contact with a support surface and a second restricting position in which the associated wheel is out of load-bearing contact with the support surface.

9. The mobile work unit according to claim 8, wherein a hydraulic motor is provided for each of the load-bearing wheels on the support legs for driving the wheels and including valve means for interrupting hydraulic oil supply to the piston-and-cylinder assemblies and transferring the oil supply to each of the hydraulic motor for individual control of each motor.

10. The mobile work unit according to claim 9, wherein the pair of the support legs to which the link-shaped members are connected is at the front end of the body member and a single load-bearing wheel is located centrally of the rear end of the body member and mounted for free pivotal movement about a vertical axis.

11. The mobile work unit according to claim 8, wherein the pair of support legs at the other end of the body member, each has a load-bearing wheel corresponding therewith, which corresponding wheel is rotatably mounted to the body member and an hydraulic motor is provided for each of said corresponding wheels for driving the wheels and including valve means for interrupting hydraulic oil supply to the piston-and-cylinder assemblies and transferring the oil supply to each hydraulic motor for individual control of each motor.

* * * * *